US005436708A

United States Patent [19]

Dreyfuss et al.

[11] Patent Number: 5,436,708

[45] Date of Patent: Jul. 25, 1995

[54] HIGH STABILITY COLOR IMAGING BY TRANSFER ROLLER

[75] Inventors: David D. Dreyfuss, Versailles; Todd L. Janes, Lexington; Alexander D. Meade, Lexington; Pramod K. Sharma, Lexington; Peter E. Wallin, Lexington, all of Ky.

[73] Assignee: Lexmark International, Inc., Greenwich, Conn.

[21] Appl. No.: 251,427

[22] Filed: May 31, 1994

[51] Int. Cl.[6] ..... G03G 15/16

[52] U.S. Cl. ..... 355/271; 355/326 R

[58] Field of Search ..... 355/271–276, 355/326 R; 430/126

[56] References Cited

U.S. PATENT DOCUMENTS

| | | | |
|---|---|---|---|
| 5,187,526 | 2/1993 | Zaretsky | 355/273 |
| 5,248,560 | 9/1993 | Baker et al. | 428/425.8 |
| 5,291,254 | 3/1994 | Shimada et al. | 355/275 |
| 5,298,956 | 3/1994 | Mammino et al. | 355/275 |
| 5,303,013 | 4/1994 | Koike et al. | 355/271 |
| 5,370,961 | 12/1994 | Zaretsky et al. | 355/271 X |

*Primary Examiner*—R. L. Moses

*Attorney, Agent, or Firm*—John A. Brady

[57] ABSTRACT

A printer or other imaging apparatus (1) in which two or more images in registration are transferred from a photoconductor (3) to an intermediate transfer drum (5). The transfer drum has very stable resistivity, which is achieved by the body of the drum being cesium iodide filled polyurethane.

6 Claims, 3 Drawing Sheets

Resistivity at 50 C (ohm-cm)
1.00E+11
1.00E+10
1.00E+09
1.00E+08
0
2
4
6
8
10
Parts per Hundred Copper II Chloride (Thousandths)

Resistivity at 50 C (ohm-cm)
1.00E+11
1.00E+10
1.00E+09
1.00E+08
0
2
4
6
8
10
Parts per Hundred Cesium Iodide (Thousandths)

HIGH STABILITY COLOR IMAGING BY TRANSFER ROLLER

TECHNICAL FIELD

This invention relates to electrophotographic imaging employing registered images on a transfer roller, which is used in subtractive color formation.

BACKGROUND OF THE INVENTION

Color imaging employing an intermediate transfer roller is known. Where such printers may be large and confined in restricted environments, suitable imaging may be obtained. This invention makes possible small apparatus with excellent results for use in an office environment.

This invention defines a controlled resistivity of an intermediate roller operative under conditions which give a wide response window to provide stable imaging in an office environment. U.S. Pat. No. 5,187,526 to Zaretsky discloses intermediate roller having a defined resistivity, which resistivity is at most about one-half of that of this invention. U.S. Pat. No. 5,248,560 to Baker et al discloses an electrophotographic roller with resistivity controlled by a metal chloride filled polyurethane, while this invention employs different filler material.

DISCLOSURE OF THE INVENTION

In accordance with this invention an intermediate transfer roller has resistivity of exceptional stability of about $2\times10^9$ ohm-cm. The resistivity is obtained by cesium iodide as a filler in the polyurethane body of the transfer drum.

BRIEF DESCRIPTION OF THE DRAWING

The details of this invention will be described in connection with the accompanying drawing in which.

BEST MODE FOR CARRYING OUT THE INVENTION

General

Figure 1:
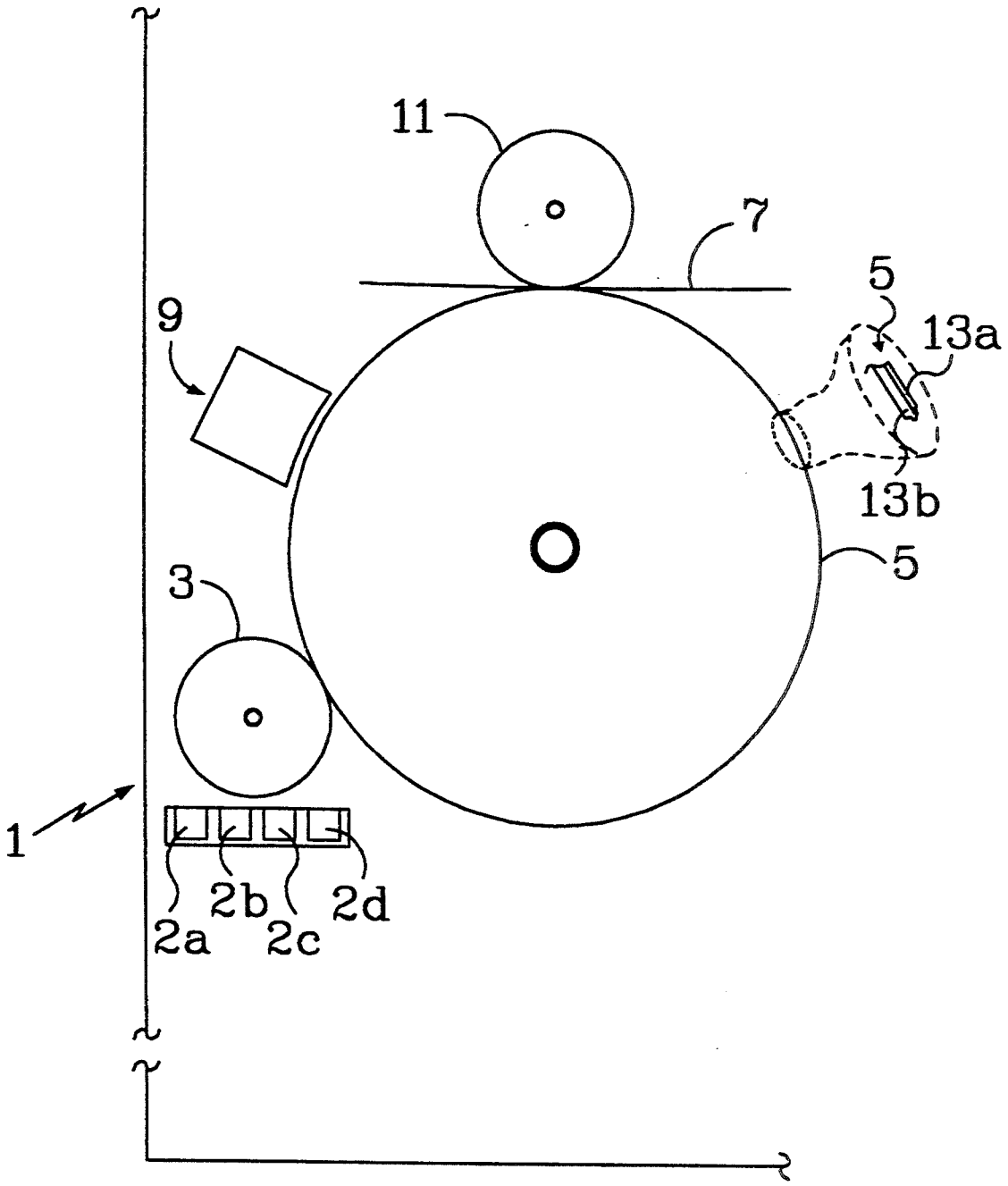
FIG. 1 is an illustrative view of an imaging apparatus showing the elements of this invention.

A typical liquid-toner color electrophotographic apparatus is shown in FIG. 1. Although this invention is disclosed in liquid color electrophotography apparatus 1, the principles can be applied to systems employing dry, or powder, toner, This invention may also be applied to monochrome process. Likewise, the imaging means may be digital (e.g., laser or light emitting diode printhead) or analog (as in a photocopy machine). This invention may employ a photoconductor 3 or use ionography or other means of producing a developed electrostatic image.

Toners of the primary process colors (cyan, magenta, yellow and black) are sequentially introduced to a charged and laser-imaged, rotatable photoconductor 3 by means of movable developer stations 2*a*, 2*b*, 2*c* and 2*d*. As each primary color is developed onto the imaged photoconductor 3, it is subsequently transferred to and accumulated on an intermediate surface 5, such as a roller or drum, which is large enough to contain the entire image. Following accumulation of all four image layers on the intermediate drum 5 surface, the image is transferred, by means of heat, mechanical pressure and/or electrical field to paper or other print media 7.

In the illustrated process, a heating station 9 heats the intermediate surface 5 prior to the point of transfer to print media 7. The heat from station 9 converts the toned image on drum 5 from discrete particles to coherent film. The heating station 9 is shown illustratively. Following conversion of the image on the intermediate drum 5 surface, paper 7 is introduced to the drum 5 surface and pressed into intimate contact with the drum 5 surface by the action of a movable pressure roller 11, which is moderately heated and is pressed against the non-image side of the print media 7 with sufficient force to ensure intimate contact between the print media 7 and the image film on the surface of drum 5 as is conventional, roller 11 is supplied with an electrical potential of sign and magnitude such that the toner image is attracted from the intermediate surface 5 to the paper 7.

Transfer of the accumulated image to print media 7 can be accomplished without the use of a heating station 9, by increasing the temperature of the transfer roller 5 and the paper to effect conversion of the particulate toner to a film at the point of transfer. Generally, however, the latter approach results in more heat energy being transferred to the transfer roller 5, which is disadvantageous in the design of a particular machine. An excellent implementation of heating station 9, which employs an electrically biased contact roller, is described and claimed in a patent application filed on the same day this application is filed and commonly assigned with this application entitled "Color Imaging With Contact Transfer Heating Station", by Todd L. Janes, Alexander D. Meade, Ashok Murthy, Pramond K. Sharma and Peter E. Wallin, which application is herein incorporated by reference.

Once transferred to print media 7, the image is fused by means, which may be entirely conventional, not shown.

This invention pertains to the material of the intermediate roller 5 or drum and in particular, the properties of the roller 5 material necessary to ensure that the transfer of toner from the photoconductor 3 to the intermediate roller 5 can be accomplished to a degree which is consistent with the production of high quality color prints.

The requirements of high quality color printing dictate that the transfer of toner from the photoconductor 3 to the intermediate drum 5 be nearly 100% for each layer of toner, regardless of whether the toner is being transferred to a drum 5 surface with no toner or to a surface which already has one, two or three previously transferred toner layers upon it. Transfer of less than 100% of the toner can result in a noticeable reduction in the image quality of color printing. In addition, it is necessary that the toner, once transferred to the drum surface, not be transferred back to the photoconductor 3 as subsequent layers of toner are being transferred. Generally, these two requirements are met by carefully researching the electrical properties which are required of the drum material, and designing materials to meet the requirements.

It is well known in the field of electrophotography that toner can be transferred between two contacting surfaces by constructing the surfaces of somewhat dielectric materials and supplying the surfaces with electrical potentials such that an electrical field is created and the receiving surface potential is of sign opposite to that of the toner, relative to the source surface, and so the electrical force acting on the charged toner particles is sufficient to overcome the forces holding the toner to the source surface. In addition, it is also well known that excessive electrical field can result in a degradation of the image quality and a loss of transfer. In particular, an electrical field exceeding the Paschen threshold in the space just prior to the transfer nip will cause ionic species of electrical charge opposite to that of the toner to be deposited on the toner layer, degrading the ability of the toner to be transferred and distorting the image. In addition to the electrical properties of a drum material, mechanical constraints are imposed. Particularly in the case of liquid toner processes, it is necessary that the pressure between the photoconductor 3 and the drum 5 surface be low to avoid degradation of the image, while it is also necessary to provide the correct nip length for the electrical forces of transfer to be effective. In general, these requirements are met by selecting a material hardness and thickness appropriate for the application.

Description of Invention

As it is necessary in a color process to transfer toner from a photoconductor 3 to an intermediate drum 5 where up to three layers of toner may already be present on the surface of the drum, and since each layer of toner on the drum 5 surface acts, as a result of the electrical charge on the toner, to reduce the electrical force of the transfer field on the toner particles being transferred, it is necessary to increase the transfer field between the transfer surface for each layer of toner. This is accomplished by increasing the difference in voltage between the two surfaces. However, since for a given image, it is necessary to transfer toner simultaneously to a bare intermediate surface and to the surface 5 already carrying up to three layers of toner, the transfer field cannot be increased beyond the point where the single-layer image is damaged either in the pre-nip region by Paschen breakdown of the air or in the nip itself by exchange of electrical charge between the transfer surface and the toner layer.

In accordance with this invention, these requirements are best met by using an intermediate drum 5 with electrical properties such that a single layer of toner can be transferred over a wide range of voltages without damaging the image. For a liquid toner process, the transfer of toner is typically 100% in the range of voltages described, and transfer of less than 100% of the toner is judged to be insufficient for high quality color printing due to the extremely thin nature of the toner layer. An additional process requirement is that the system be resistant to transfer of toner back to the photoconductor 3, with any amount of back-transferred toner judged to be excessive.

In optimizing the described transfer process for a process speed of 2 inches per second, and using elastomeric drum materials such that the force between the photoconductor 3 and the intermediate drum 5 was kept reasonably low (about 4 Kg total load) with a nip width of 1–5 mm (preferably 2–3 mm), a range of drum electrical resistivities was used. It was found that, if the electrical resistivity was low, the size of the voltage window effecting 100% transfer of toner was small, and that the image, once transferred to the intermediate drum 5, would transfer back to the photoconductor on subsequent revolutions of drum 5, and that the amount of toner back-transferred would increase as the transfer field was increased. It was also found that the back-transfer was not due to Paschen breakdown of air in the pre-transfer nip, as the problem could be alleviated somewhat by reducing the width of the transfer nip, suggesting that the back-transfer was caused by an exchange between the toner and the drum surface in the transfer nip, resulting in toner with insufficient charge to resist the surface forces tending to cause back-transfer.

If the electrical resistivity of the intermediate drum was large, the transfer window was also small, suggesting that, in the limiting case of a too resistive drum, an effective transfer field could only be established in the transfer nip at drum voltages which cause Paschen breakdown of air in the pre transfer nip. Back-transfer of toner to the photoconductor did not occur, further suggesting that back-transfer is not a result of air breakdown in the pre-transfer nip.

Figure 2:
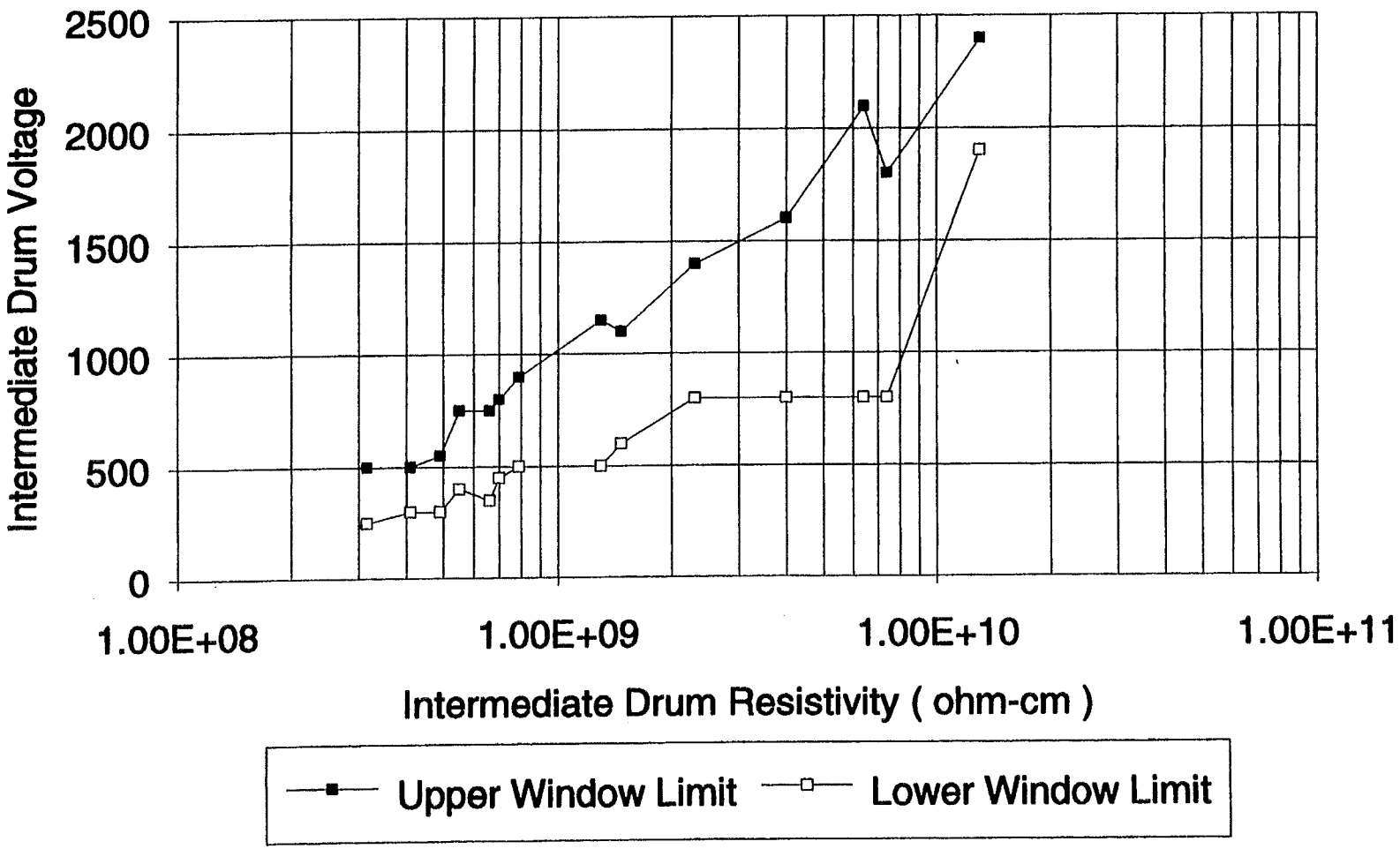
FIG. 2 is a graph illustrating the range of results employed to choose the resistivity of the intermediate roller.

At intermediate resistivities, the transfer window was found to be quite large, and back-transfer to be nonexistent at the designed nip width. In particular, a drum resistivity of $2\times10^9$ ohm-cm to $8\times10^9$ ohm-cm (for four layers transferred) was found to offer transfer window size sufficient to transfer four layers of toner without exceeding the field limit for a single layer of toner and without creating a condition causing back-transfer of toner to the photoconductor. At resistivities below $2\times10^9$ ohm-cm, the size of the transfer window consistently decreased and back-transfer became increasingly apparent. At resistivities above $8\times10^9$ ohm-cm, the size of the transfer window also consistently decreased. In addition, the required voltages for transfer became quite high, exceeding 2 KV and introducing practical considerations, as maintaining a large drum at such voltages can be problematic. See FIG. 2. Since practical color printing requires only three layers transferred, (black toner not being applied over three-color black) the range of operative drum resistivity is $8\times10^8$ to $8\times10^9$ ohm-cm, preferably 2 to $5\times10^9$ ohm-cm.

In order to prevent image degradation at the transfer nip due to excessive mechanical pressures, it was found that elastomer hardnesses on tile periphery of drum 5 should be of 30 to 60 Shore A. The elastomer coated to a thickness of 1–3 mm on the periphery of a hollow aluminum or steel cylinder produced drums 5 having workable nip sizes for the process speed being used, with the mechanical load between the two surfaces 4 Kg or less. As the hardness of the drum was increased, the load necessarily increased to maintain the desired transfer nip thereby causing image distortion, and a squeezing of carrier liquid from the toned image caused further gross distortions of the image. Reducing the load to a point preventing image distortions caused the transfer nip to be small, so that the maximum transfer field was reduced, and the drum voltage requirement increased, resulting in a smaller transfer window similar to the case of a high resistivity drum material. The surface of drum 5 should preferably be a spray, or dip coated, glossy, smooth surface, with an average roughness, $R_a$, of less than 0.3 microns.

In general, for given process speed, in order to obtain the largest possible transfer windows, it is necessary to select nip width and electrical resistivity. For a process speed of 2 ips, and for reasonable elastomer hardnesses resulting in a transfer nip width of 2–3 mm, the ideal drum resistivity is $2–5\times10^9$ ohm-cm. To increase the process speed would necessitate either increasing the nip width proportionally to the process speed or decreasing the resistivity in the same proportion. Since the hardness of the drum elastomer and the force between the surfaces can only be varied within a reasonable range, the transfer system is best optimized for a given process speed by varying the resistivity in a manner inversely proportional to the speed of the process.

Filled Polyurethane Intermediate Drum Surface

The foregoing is effective for printers and copiers in an office environment when the resistivity in that environment is exceptionally stable. In liquid toner electrophotographic processes, properties of surfaces forming the image are critical. In particular, the design requirements of intermediate drum 5 dictate that it have an elastomeric coating of excellent wear properties, of release properties of the surface compatible with the release of toner for hundreds of thousands of impressions, of hardness of the surface which can conform to the irregularities of paper, and of electrical properties allowing transfer of toner to and from the surface.

As the electrical properties are typically quite sensitive to temperature and humidity, varying over an order of magnitude, it is common to operate the sensitive surfaces of such an electrophotographic process at a controlled temperature, elevated above room ambient, which further limits choices of materials for such an application.

Of the material choices available given the multiple restrictions imposed by an electrophotographic process, it has been found that some polyurethanes are excellent candidates. In particular, they can offer excellent wear resistance, consistent surface properties over life, and can withstand elevated temperatures for extended periods of time. In general, however, the electrical resistivity of polyurethanes is too high to be of practical use. For the illustrated process, the optimum resistivity has been found to be about $2\times10^9$ ohm-cm, and polyurethane materials are generally of resistivity at least $1\times10^{10}$ ohm-cm at the desired operating temperatures. This embodiment employs Vibrathane (trademark) 8011 polyurethane, a product of Uniroyal Chemical Co., Inc., which is a castable, stable and abrasion resistant resin.

A method sometimes used to decrease the resistivity of elastomers in general and polyurethanes in particular is to add small amounts of various soluble salts prior to curing the elastomer. The resulting ionic conduction of the elastomer is controlled by the mobility of the ionic species.

Figure 3A:
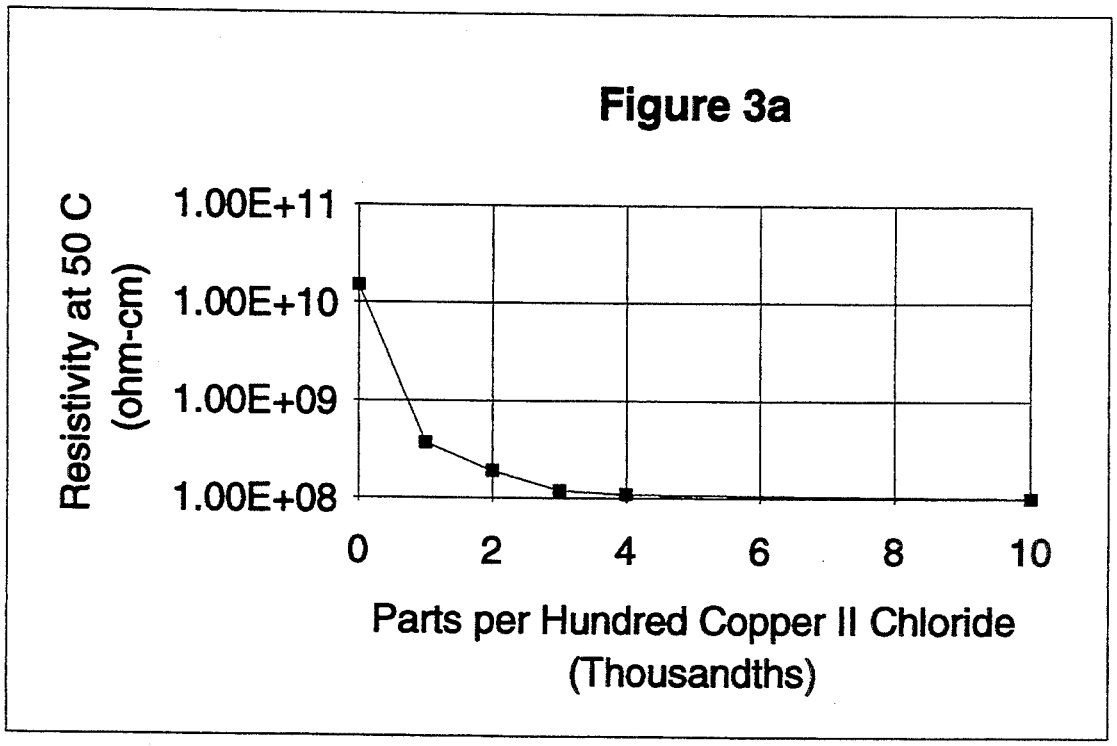
FIGS. 3*a* and 3*b* illustrate the resistivity of cesium iodide and copper II chloride filled polyurethane samples.

By increasing the concentration of a known salt filler, copper II chloride, in the elastomer, the resistivity is found to drop at 50° C. in a manner shown in FIG. 3*a*. Initially, the slope of the resistivity vs. concentration curve is quite steep, and as the concentration is increased, the resistivity changes by smaller and smaller amounts. In order to produce consistent results, it is necessary to find a salt which generates the desired elastomer resistivity at salt concentrations greater than those on the steep part of the curve. For the salt shown in FIG. 3*a* (copper II chloride), the flat pad of the curve produces an electrical resistivity at 50° C. of $1\times10^8$ ohm-cm, undesirably low for use in an electrophotographic process.

Figure 3B:
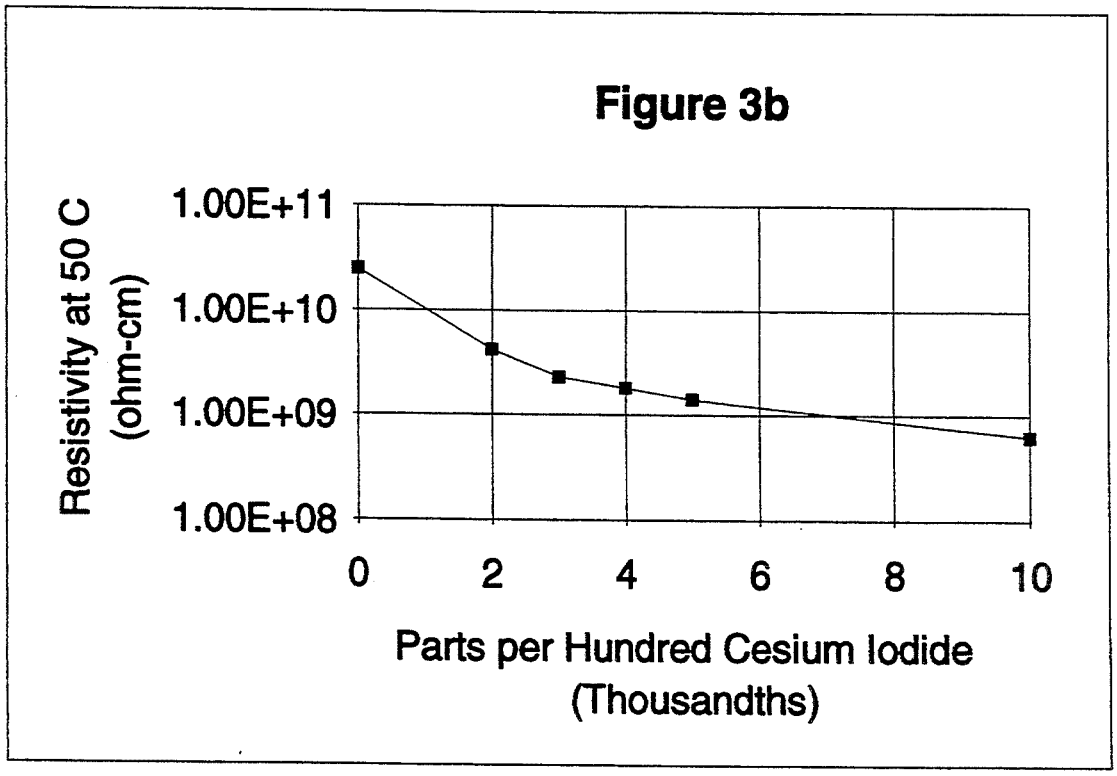

In accordance with this invention it has been found that by using cesium iodide to modify the resistivity of Vibrathane 8011 polyurethanes, the curve at 50° C. of electrical resistivity vs. cesium iodide concentration is as shown in FIG. 3*b*. *The desired resistivity,* $2\times10^9$ ohm-cm, is obtained at a concentration beyond the range where the curve is steep using cesium iodide as a resistivity modification agent, so that consistent electrical properties in the desired range can be obtained with polyurethane materials. For such stability, the cesium iodide is of at least about 0.002 parts by weight cesium iodide to 100 parts by weight Vibrathane 8011 polyurethane.

Cesium iodide is ionic and therefore material using it as a conductive filler has a limited life as the ions plate out. For a theoretically unlimited life, a conductive filler, specifically polyaniline, whose conductivity is electronic in nature instead of ionic, may be used. Versicon (trademark) polyaniline commercially available from Allied Signal Inc. is an example of such a material which can be employed instead of the cesium iodide in polyurethane. In addition, for the polyaniline the resistivity with increased load changes more gradually and there are no "steep" regions to avoid.

Copolymer Polyurethane and Silicon Intermediate Drum Surface

Currently preferred is an intermediate drum surface which is copolymer of polydimethylsiloxane and polyurethane as described and claimed in a patent application filed on the same day this application is filed and commonly assigned with this application entitled "Polymeric Toner Transfer Member Material", by David D. Dreyfuss, Todd L. Janes, Alexander D. Meade, Jeanne M. Saldanha-Singh and Peter E. Wallin, which application is herein incorporated by reference.

Specific Embodiment

The foregoing describes a system in which the drum elastomer consists of only one layer, with electrical and mechanical properties homogeneous throughout the layer.

In a specific embodiment, the intermediate transfer roller 5 is a hollow steel or aluminum drum having an outer layer 13*a* of a polyurethane, softer than Vibrathane 8011, 200 microns thick. This material may be Monothane (trademark, product of Synair Corp.) polyurethane which, unaltered, has the desired resistivity. Immediately under and in contact with outer layer 13*a* is layer 13*b*, which is the cesium iodide doped Vibrathane polyurethane as described in the foregoing in a thickness of 2 millimeter. The softer urethane is to provide compliance with the paper 7 during image transfer since paper is rough in relation to the size of the toner image and transfer is achieved by compliance with the roughness of the paper.

The drum 5 is 120 millimeters in diameter so as to receive a full image. Photoconductor 3 is a roller 40 millimeters in diameter. It should be noted, however, that the factors described above are not limited in application to a system employing rollers of the stated diameters, as has been verified by employing a transfer roller 5 as small as 36 millimeters in diameter.

Variations within the spirit and scope of this invention will be apparent or can be anticipated. In particular intermediate drum 5 and other endless members may be belts rather than rollers. Also, as an alternative to heating station 9, paper 7 may be heated prior to entering the nip of intermediate transfer roller 5 and impression roller 11. Drum 5 may have up to about 10% of its resin thickness (13*a* plus 13*b*) as an outer, second layer 13*a* as described to provide mechanical properties of softness, abrasion resistance or paper release. Where such outer layer 13*a* is very thin, it may be significantly more resistive than the lower layer 13*b*.

We claim:

1. An imaging apparatus comprising an electrically chargeable roller, means to tone said chargeable roller in the pattern of an image, an intermediate transfer roller to accumulate a plurality of said toned images in registration by electrostatic transfer from said chargeable roller, and a transfer station to transfer said accumulated images by pressure from said intermediate transfer roller to paper or other substrate, said intermediate transfer roller comprising a filled resin having a stable resistivity of $8\times10^8$ to $8\times10^9$ ohm-cm at 50° C.

2. The imaging apparatus as in claim 1 in which said resistivity of said transfer roller is about $2\times10^9$ ohm-cm.

3. The imaging apparatus as in claim 1 in which said transfer roller comprises polyurethane resin filled with cesium iodide.

4. The imaging apparatus as in claim 2 in which said filled resin is cesium iodide filled polyurethane.

5. An intermediate transfer roller for electric transfer of toned images from a chargeable roller, said intermediate transfer roller comprising polyurethane resin filled with cesium iodide.

6. The intermediate transfer roller as in claim 5 in which said cesium iodide is in an amount of at least about 0.002 parts by weight to 100 parts by weight of said polyurethane resin.

* * * * *